US005918838A

United States Patent [19]

Strandberg

[11] Patent Number: 5,918,838

[45] Date of Patent: Jul. 6, 1999

[54] BABY BOTTLE HOLDER

[76] Inventor: Gun Strandberg, 10164 Bannister St., Spring Hill, Fla. 34608

[21] Appl. No.: 08/796,144

[22] Filed: Feb. 6, 1997

[51] Int. Cl.[6] ..... A47D 15/00

[52] U.S. Cl. ..... 248/106; 248/102; 248/141

[58] Field of Search ..... 248/102–107, 248/130, 133, 141, 292.13, 313

[56] References Cited

U.S. PATENT DOCUMENTS

| | | | |
|---|---|---|---|
| 1,017,102 | 2/1912 | Kaufman | 248/313 |
| 2,744,649 | 5/1956 | Smith | 248/313 |
| 2,745,616 | 5/1956 | Gomes | 248/141 |
| 2,807,430 | 9/1957 | Medlock | 248/106 |
| 2,880,950 | 4/1959 | Williams et al. | 248/102 |
| 2,948,499 | 8/1960 | Manny | 248/106 |
| 4,014,505 | 3/1977 | Dowd | 248/105 |

FOREIGN PATENT DOCUMENTS

| | | | |
|---|---|---|---|
| 457995 | 7/1949 | Canada | 248/105 |
| 614016 | 12/1960 | Italy | 248/313 |

*Primary Examiner*—Derek J. Berger

[57] ABSTRACT

A baby bottle holder includes a wide base for stability with side members projecting upward and inward therefrom, a bottle support having a semi-circular cylindrical wall suitable for inserting a baby bottle therein, the wall biased inwardly to releasably grip the bottle, the bottle support pivotally mounted between the side members and weighted to assume a vertical position to facilitate insertion of the bottle, the apex of each side member adjacent the pivotal mounts being hinged to allow for angular movement in response to the cylindrical wall flexing outward upon insertion of the baby bottle.

1 Claim, 1 Drawing Sheet

BABY BOTTLE HOLDER

BACKGROUND OF THE INVENTION

The present invention relates generally to aids for feeding infants and invalids and pertains, more specifically, to a freestanding baby bottle holder that supports and pivots the bottle to an appropriate position for feeding a baby.

Baby bottle holders are known and, heretofore, have been configured in different ways. Some examples of bottle holders in the prior art are seen in the following U.S. patents:

Williams, U.S. Pat. No. 2,880,950, shows a pivoting bottle holder attached to a base that sits upon the baby's chest. In this position, it may cause breathing difficulties or slide off the baby.

Smith, U.S. Pat. No. 1,287,125, utilizes a steel strap around the baby's body which may induce breathing problems.

Medlock, U.S. Pat. No. 2,807,430, has devised a pivoting holder that is adjustable vertically and horizontally. The construction, however, is complex and thereby costly.

Baclit, U.S. Pat. No. 3,620,491, provides a pivoting bottle holder that straddles a baby without resting upon it. Again, the construction is complex and expensive.

MacNeil, U.S. Pat. No. 4,121,797, shows a pivoting bottle holder that mounts on a child's seat, but cannot be used freestanding in a crib.

SUMMARY OF THE INVENTION

It is therefore an object of the present invention to provide a baby bottle holder that is freestanding so that it can be used on any surface that a baby would be placed upon, such as a crib, and moved into position near the baby.

Another object of the invention is to provide a baby bottle holder of the type described that allows the bottle to be pivoted to an angle appropriate for feeding a baby.

Still another object of the invention is to provide a baby bottle holder of the type described that has a weighted bottle support that will pivot into a vertical position to allow quick and easy insertion and removal of the bottle.

Yet another object of the invention is to provide a baby bottle holder of the type described in which the bottle support is biased to grip the bottle securely, and yet release it easily.

A further object of the invention is to provide a baby bottle holder of the type described that is wider at the base than at the bottle support for stability.

A yet further object of the invention is to provide a baby bottle holder of the type described that can be manufactured cost effectively in large numbers of high quality.

A still further object of the invention is to provide a baby bottle holder of the type described and which is rugged in construction to ensure reliable operation and long life.

The above objects, as well as further objects and advantages, are attained by the present invention which may be described briefly as a baby bottle holder, comprising: a base having a bottom portion with an upper and a lower surface, the lower surface being substantially flat; first and second side members, spaced apart, attached to the bottom portion and projecting upward therefrom; a bottle support having a longitudinal axis, a generally cylindrical outer surface extending along the longitudinal axis, a generally cylindrical inner surface extending along the longitudinal axis, the inner and outer surfaces forming a cylindrical wall having two opposite ends, the inner surface having a diameter suitable for inserting a baby bottle therein, the bottle support having a transverse axis perpendicular to the longitudinal axis, the bottle support juxtaposed between the first and second side members with the transverse axis positioned horizontally and extending through the side members; and pivotal means for pivotal attachment of the bottle support to the first and second side members so that upon inserting a bottle into the bottle support, the bottle will be pivoted to an angle suitable for feeding the baby.

BRIEF DESCRIPTION OF THE DRAWING

The invention will be more fully understood, while still further objects and advantages will become apparent, in the following detailed description of preferred embodiments thereof illustrated in the accompanying drawing in which.

DESCRIPTION OF THE PREFERRED EMBODIMENT

Figure 1:
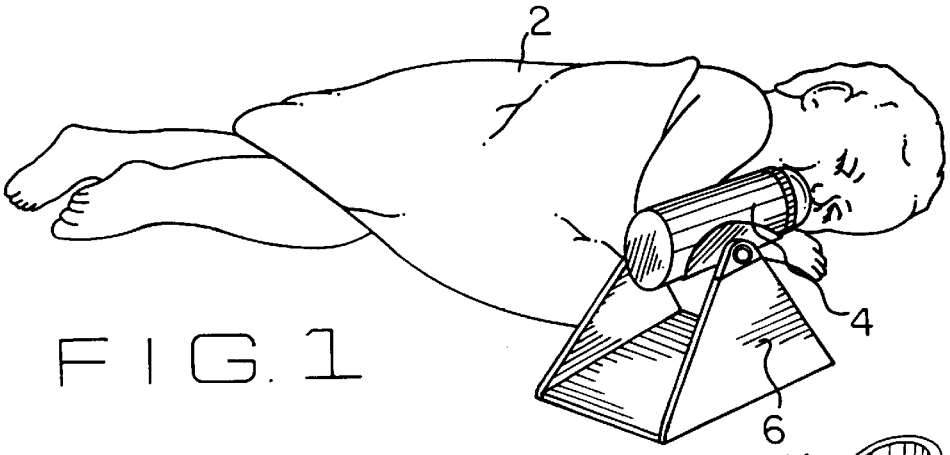
FIG. 1 is a perspective view of a baby feeding from a bottle supported by a bottle holder constructed in accordance with the invention.
Figure 2:
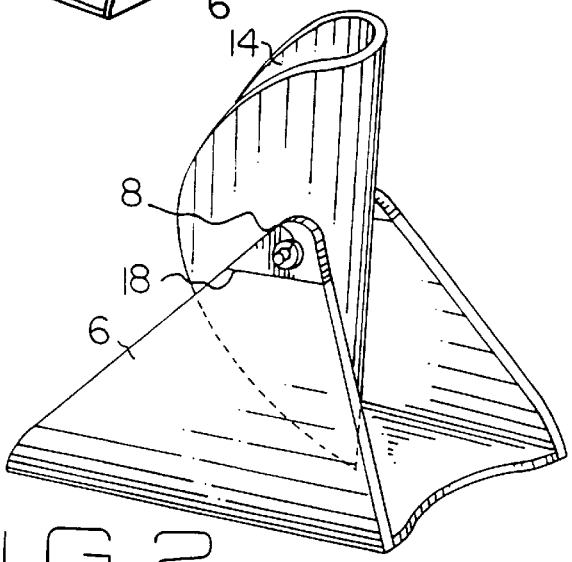
FIG. 2 is a perspective view of the bottle holder of FIG. 1.
Figure 3:
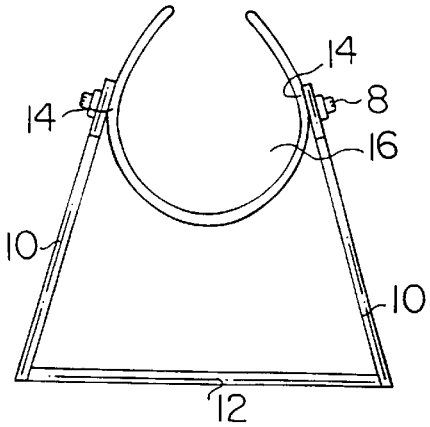
FIG. 3 is a front elevational view of the bottle holder of FIG. 1.
Figure 4:
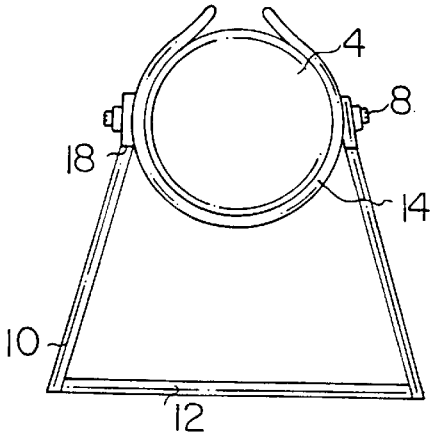
FIG. 4 is a front elevational view of the bottle holder of FIG. 1, showing the bottle inserted into the bottle holder.

Referring now to the drawing, a baby bottle holder is shown having a base 6 with a bottom portion 8 which has an upper surface 10 and a lower surface 12, and parallel first and second edges, 14 and 16 respectively, spaced apart a distance greater than the bottle support. The base 6 also includes first side member 18 in the shape of a triangle having a straight edge 22 and an apex 26 opposite the straight edge 22, the apex 26 having a hole 34, the straight edge 22 attached to the bottom portion first edge 14 and the first side member 18 projecting upward at an acute angle to the bottom portion 8, and a second side member 20 in the shape of a triangle having a straight edge 24 and an apex 28 opposite the straight edge 24, the apex 28 having a hole 36, the straight edge 24 attached to the bottom portion second edge 16 and the second side member 20 projecting upward at an acute angle to the bottom portion 8.

The bottle holder includes a bottle support 38 having a generally cylindrical outer surface 48 and a generally cylindrical inner surface 50, together forming a cylindrical wall 52 having two opposite ends 54 and 56. The cylindrical wall 52 includes a cross section configured in a semi-circle opening upward, and establishing transversely opposite first and second wall portions 40 and 42 respectively, of the cylindrical wall 52, which has a diameter that tapers slightly along the longitudinal axis to facilitate insertion of the baby bottle 58 into the bottle support 38. The cylindrical wall 52 is flexible and resilient, and the wall portions 40 and 42 are biased inwardly toward one another, by virtue of their inherent resilience, to releasably grip the baby bottle 58.

The bottle support 38 is pivotally attached to the side members 18 and 20 by a first trunnion 44 mounted on the first wall portion 40 and pivotally engaging the apex hole 34 of the first side member 18, and by a second trunnion 46 mounted on the second wall portion 42 and pivotally engaging the apex hole 36 of the second side member 20, so that the bottle 58 can assume an angle appropriate for feeding the baby 62.

The first side member apex 26 is connected to the first side member 18 by a hinge means along a horizontal flex line 31 immediately below the pivot hole 34, and the second side member apex 28 is connected to the second side member 20 by a hinge means along a horizontal flex line 33 immediately below the pivot hole 36, so that each apex is free to assume an angular displacement with respect to the side member to which it is connected, as each apex and it's respective trunnion is angularly displaced in response to the wall portion bending outward as the baby bottle is inserted into the bottle support.

The bottle support 38 has a weight 60 attached to one end 56 of the cylindrical wall 52 to tilt the bottle support 38 into a vertical position to facilitate insertion of the baby bottle 58 into the bottle holder.

It is to be understood that the above detailed description of the preferred embodiment of the invention is provided by way of example only. Various details of design and construction may be modified without departing from the true spirit and scope of the invention as set forth in the appended claims.

I claim:

1. A baby bottle holder, comprising:

(a) a base having a bottom portion with an upper and a lower surface, the lower surface being substantially flat;

(b) first and second side members, spaced apart, attached to the bottom portion and projecting upward therefrom, the side members tapering inwardly from the bottom portion, each of the side, members having an apex portion including a pivot hole therethrough, the apex portion being connected to the side members by a horizontal flex line immediately below the pivot hole, so that the apex portion is free to assume an angular displacement with respect to the side member;

(c) a bottle support having a longitudinal axis, a generally outer surface extending along the longitudinal axis, a generally inner surface extending along the longitudinal axis, the inner and outer surfaces forming a wall having two opposite ends, the inner surface having a diameter suitable for inserting a baby bottle therein, the bottle support juxtaposed between the first and second side members, the wall being flexible and resilient and having a cross-section configured in a semi-circle upward facing opening thereby establishing transversely opposite first and second wall portions of the wall, the bottle support having a diameter tapering slightly along the longitudinal axis to facilitate insertion of the baby bottle therein; and (d) pivotal means for pivotal attachment of the bottle support to the first and second side members so that upon inserting a bottle into the bottle support, the bottle will be pivoted to an angle suitable for feeding the baby, the pivotal means including a first trunnion and a second trunnion pivotally engaging the pivot holes of the first and second side members.

* * * * *